US008206553B2

(12) United States Patent
Gelman et al.

(10) Patent No.: US 8,206,553 B2
(45) Date of Patent: Jun. 26, 2012

(54) RETENTION AND DRAINAGE IN THE MANUFACTURE OF PAPER

(75) Inventors: Robert A. Gelman, Newark, DE (US); Erin A. S. Doherty, Hockessin, DE (US)

(73) Assignee: Hercules Incorporated, Wilmington, DE (US)

( * ) Notice: Subject to any disclaimer, the term of this patent is extended or adjusted under 35 U.S.C. 154(b) by 232 days.

(21) Appl. No.: 11/313,505

(22) Filed: Dec. 21, 2005

(65) Prior Publication Data

US 2006/0289137 A1 Dec. 28, 2006

Related U.S. Application Data

(60) Provisional application No. 60/693,852, filed on Jun. 24, 2005.

(51) Int. Cl.

| | |
|---|---|
| ***D21H 17/43*** | (2006.01) |
| ***D21H 17/45*** | (2006.01) |
| ***D21H 21/10*** | (2006.01) |
| ***D21H 23/04*** | (2006.01) |

(52) U.S. Cl. ..... 162/168.3; 162/158; 162/168.1; 162/185; 526/72; 526/81; 526/287; 526/312; 526/317.1

(58) Field of Classification Search ..... 162/168.1, 162/168.3, 158, 185; 526/72, 81, 287, 312, 526/317.1

See application file for complete search history.

(56) References Cited

U.S. PATENT DOCUMENTS

| | | | | |
|---|---|---|---|---|
| 2,728,751 | A * | 12/1955 | Catlin et al. | 526/310 |
| 4,103,080 | A | 7/1978 | Bohmer et al. | 526/303 |
| 4,959,432 | A * | 9/1990 | Fan et al. | 526/287 |
| 5,167,766 | A | 12/1992 | Honig et al. | 162/164.1 |
| 5,171,808 | A | 12/1992 | Ryles et al. | 526/264 |
| 5,268,452 | A * | 12/1993 | Siebert et al. | 525/437 |
| 5,420,216 | A | 5/1995 | Guo et al. | 526/86 |
| 6,391,984 | B1 | 5/2002 | Grolitzer et al. | 526/65 |
| 6,417,268 | B1 | 7/2002 | Zhang et al. | 524/833 |
| 6,667,373 | B2 | 12/2003 | Grolitzer et al. | 526/65 |
| 6,759,490 | B1 | 7/2004 | Gerst et al. | 526/86 |
| 2004/0102528 | A1 | 5/2004 | Walchuk et al. | 516/20 |
| 2004/0143039 | A1 | 7/2004 | Hollomon et al. | 524/35 |
| 2005/0236123 | A1 * | 10/2005 | McNamara et al. | 162/158 |

FOREIGN PATENT DOCUMENTS

WO WO 03/050152 * 6/2003

* cited by examiner

*Primary Examiner* — Matthew Daniels
*Assistant Examiner* — Dennis Cordray
(74) *Attorney, Agent, or Firm* — Joanne Mary Fobare Rossi; Robert O'Flynn O'Brien

(57) ABSTRACT

A method of improving retention and drainage in a papermaking process is disclosed. The method provides for the addition of an associative polymer, prepared by an inverse emulsion polymerization process that utilizes multiple, discrete additions of initiator. Additionally, a process for preparation of an associative polymer, prepared by an inverse emulsion polymerization process that utilizes multiple discrete additions of initiator is disclosed.

11 Claims, No Drawings

RETENTION AND DRAINAGE IN THE MANUFACTURE OF PAPER

CROSS REFERENCE TO RELATED APPLICATIONS

This application claims the benefit of U.S. Provisional Application No. 60/693,852, filed Jun. 24, 2005, the entire content of which is herein incorporated by reference.

FIELD OF THE INVENTION

This invention relates to the process of making paper and paperboard from a cellulosic stock, employing a flocculating system.

BACKGROUND

Retention and drainage is an important aspect of papermaking. It is known that certain materials can provide improved retention and/or drainage properties in the production of paper and paperboard.

The making of cellulosic fiber sheets, particularly paper and paperboard, includes the following: 1) producing an aqueous slurry of cellulosic fiber which may also contain inorganic mineral extenders or pigments; 2) depositing this slurry on a moving papermaking wire or fabric; and 3) forming a sheet from the solid components of the slurry by draining the water.

The foregoing is followed by pressing and drying the sheet to further remove water. Organic and inorganic chemicals are often added to the slurry prior to the sheet-forming step to make papermaking less costly, more rapid, and/or to attain specific properties in the final paper product.

The paper industry continuously strives to improve paper quality, increase productivity, and reduce manufacturing costs. Chemicals are often added to the fibrous slurry before it reaches the papermaking wire or fabric to improve drainage/dewatering and solids retention; these chemicals are called retention and/or drainage aids.

Drainage or dewatering of the fibrous slurry on the papermaking wire or fabric is often the limiting step in achieving faster paper machine speeds. Improved dewatering can also result in a drier sheet in the press and dryer sections, resulting in reduced energy consumption. In addition, as this is the stage in the papermaking method that determines many of the sheet final properties, the retention and drainage aid can impact performance attributes of the final paper sheet.

With respect to solids, papermaking retention aids are used to increase the retention of fine furnish solids in the web during the turbulent method of draining and forming the paper web. Without adequate retention of the fine solids, they are either lost to the mill effluent or accumulate to high levels in the recirculating white water loop, potentially causing deposit buildup. Additionally, insufficient retention increases the papermakers' costs due to loss of additives intended to be adsorbed on the fiber. Additives can provide opacity, strength, sizing or other desirable properties to the paper.

High molecular weight (MW) water-soluble polymers with either cationic or anionic charge have traditionally been used as retention and drainage aids. The efficacy of the polymers or copolymers used will vary depending upon the type of monomers from which they are composed, the arrangement of the monomers in the polymer matrix, the molecular weight of the synthesized molecule, and the method of preparation.

Recent development of inorganic microparticles, when used as retention and drainage aids in combination with high MW water-soluble polymers, have shown superior retention and drainage performance compared to conventional high MW water-soluble polymers. U.S. Pat. Nos. 4,294,885 and 4,388,150 teach the use of starch polymers with colloidal silica. U.S. Pat. Nos. 4,643,801 and 4,750,974 teach the use of a coacervate binder of cationic starch, colloidal silica, and anionic polymer. U.S. Pat. No. 4,753,710 teaches flocculating the pulp furnish with a high MW cationic flocculant, inducing shear to the flocculated furnish, and then introducing bentonite clay to the furnish.

It had been found recently that water-soluble copolymers prepared under certain conditions exhibit unique physical characteristics. These polymers are prepared without chemical cross-linking agents. Additionally, the copolymers provide unanticipated activity in certain applications, including papermaking applications, such as retention and drainage aids. The anionic copolymers that exhibit the unique characteristics were disclosed in WO 03/050152 A1, the entire content of which is herein incorporated by reference. The cationic and amphoteric copolymers which exhibit the unique characteristics were disclosed in U.S. patent application publication 2004/0143039 A1, the entire content of which is herein incorporated by reference.

The use of inorganic particles with linear copolymers of acrylamide, is known in the art. Recent patents teach the use of these inorganic particles with water-soluble anionic polymers (U.S. Pat. No. 6,454,902) or specific crosslinked materials (U.S. Pat. Nos. 6,454,902, 6,524,439 and 6,616,806). However, there still exists a need to improve drainage and retention performance.

SUMMARY OF THE INVENTION

A method of improving retention and drainage in a papermaking process is disclosed. The method provides for the addition of an improved associative polymer to a pulp slurry wherein the improvement of the polymer is provided by discrete, multiple additions of the free radical initiator.

Additionally, a process for preparing an improved associative polymer is disclosed.

Additionally, a composition comprising an improved associative polymer and other materials and optionally further comprising cellulose fibers useful in providing improved retention and drainage in a papermaking process is disclosed.

DETAILED DESCRIPTION OF THE INVENTION

The present invention provides for an improved water-soluble copolymer prepared under certain conditions (herein referred to as "associative polymer"). It has surprisingly been found that the use of a sequence of discrete additions of initiator during the polymerization process results in an associative polymer (such as the polymer disclosed in WO 03/050152 A1 or US 2004/0143039 A1, the entire content of each is herein incorporated by reference) that has improved properties such as enhanced retention and drainage performance over the associative polymer disclosed in WO 03/050152 A1 or US 2004/0143039.

For the purposes of this invention, "discrete addition of initiator" means those additions of initiator that occur after the initial aliquot of initiator was added to start the polymerization reaction and before the addition of burnout aliquots of initiator used to reduce the residual levels of monomer to commercially acceptable levels. Burnout aliquots are those that are added after the reaction is greater than about 95% complete.

The present invention also provides for a novel composition comprising the associative polymer and other materials.

The present invention also provides for a composition comprising an associative polymer, other materials and cellulose fiber.

It is also observed that the use of the associative polymer as a retention and drainage aid has an impact on the performance of other additives in the papermaking system. Improved retention and/or drainage can have both a direct and indirect impact. A direct impact refers to the retention and drainage aid acting to retain the additive. An indirect impact refers to the efficacy of the retention and drainage aid to retain filler and fines onto which the additive is attached by either physical or chemical means. Thus, by increasing the amount of filler or fines retained in the sheet, the amount of additive retained is increased in a concomitant manner. The term filler refers to particulate materials, typically inorganic in nature, that are added to the cellulosic pulp slurry to provide certain attributes or be a lower cost substitute of a portion of the cellulose fiber. Their relatively small size, on the order of 0.2 to 10 microns, low aspect ratio and chemical nature results in their not being adsorbed onto the large fibers yet too small to be entrapped in the fiber network that is the paper sheet. The term fines refers to small cellulose fibers or fibrils, typically less than 0.2 mm in length and/or able to pass through a 200 mesh screen.

As the use of the retention and drainage aid increases the amount of additive retained in the sheet, the effect of the additive is increased. This provides either an enhancement of the property, providing a sheet with increased performance attribute, or allows the papermaker to reduce the amount of additive added to the system, reducing the cost of the product. Moreover, the amount of these materials in the recirculating water, or whitewater, used in the papermaking system is reduced. This reduced level of material, that under some conditions can be considered to be an undesirable contaminant, can provide a more efficient papermaking process or reduce the need for scavengers or other materials added to control the level of undesirable material.

The term additive, as used in the above, refers to materials added to the paper slurry to provide specific attributes to the paper and/or improve the efficiency of the papermaking process. These materials include, but are not limited to, sizing agents, wet strength resins, dry strength resins, starch and starch derivatives, dyes, contaminant control agents, antifoams, and biocides.

As practiced in the art, polymerization of an inverse emulsion is initiated using one of several types of initiators. Conventionally, the initiator is added and the reaction proceeds, often with an exotherm, over a period of hours. This single introduction of initiator starts the reaction, which continues until all the radicals are consumed. At the point where reaction ceases, most of the monomer (greater than 95%) has been incorporated into the polymer. However, there can be residual monomer present at levels in the tens of thousands of ppm on a molar basis. A second, often larger, aliquot of initiator is added to polymerize the remaining residual monomer, often referred to as burnout. This step creates lower molecular weight material. Additional aliquot(s) can be added to reduce the monomer level to a level of several hundred ppm on a molar basis, this is also considered burnout.

Alternative approaches involved continuous addition of most of the initiator during the polymerization, a second addition of a mixture of monomer and initiator after the initial reactor charge is polymerized, and addition of mixtures of initiator and specific polymerization regulators.

The present inventive process is a departure from standard practice in that discrete aliquots of initiator are added at intervals during the initial period of the reaction. For the purposes of this invention, the initiator mixture is added to the polymerization mixture without any additional materials. The initiator mixture is a mixture of initiator with a carrier solvent. No additional monomer is added with the intiator or once the polymerization has been initiated. For example, a typical or standard polymerization reaction may have involved introduction of the initial aliquot of initiator followed by a reaction time of 4 hours, with no additional initiator added during the 4 hour reaction period during which greater then 90% or the monomer is reacted. Generally there is a final aliquot of initiator added to the reaction mixture after this 4 hour reaction period, when the reaction is considered complete (greater then 95% reacted) to burn out residual monomer. In the present invention there can be more than one aliquot of initiator added during the reaction period prior to any addition of a burnout aliquot. These are separate additions not related to the final burnout of the monomer. For example, the first aliquot is added to begin the polymerization, a second aliquot of initiator might be added after 1 hour and a third aliquot of initiator might be added after 2 hours. The inventive step is the use of up to 5, preferably up to 3 and more preferably 2 additional aliquots of initiator during the first two hours of the reaction to create new radicals while there is significant monomer still present in the batch, ensuring that most monomer is reacted for form a high molar mass product usable in the application.

In one embodiment of the invention the initial aliquot of initiator is added to begin the polymerization reaction. It is preferred that one or more discrete additions of initiator are added when the polymerization reaction is from about 1% to about 90% complete. One or more discrete additions of initiator can be added when the polymerization reaction is from about 5% to about 90% complete. One or more discrete additions of initiator can be added when the polymerization reaction is from about 5% to about 80% complete. One or more discrete additions of initiator can be added when the polymerization reaction is from about 5% to about 60% complete. One or more discrete additions of initiator can be added when the polymerization reaction is from about 10% to about 60% complete. What is meant by the "percentage complete" is the percentage of the initial monomers that has been incorporated into polymer chains. Additional aliquots of initiator can be added during the reaction period and at the end of the reaction period.

In one embodiment of the invention the initial aliquot of initiator is added to begin the polymerization reaction. When the polymerization reaction is about 5% to about 50% complete a discrete addition of initiator is added to the reaction mixture, when the reaction is from about 15% to about 60% complete a discrete aliquot of initiator is added to the reaction mixture. Additional discrete additions of initiator can be added during the reaction period and at the end of the reaction period.

In another embodiment of the invention the initial initiator is added to begin the polymerization reaction. When the polymerization reaction is about 30% to about 75% complete a second aliquot of initiator is added to the reaction mixture, when the reaction is from about 50% to about 90% complete a third aliquot of initiator is added to the reaction mixture. Additional aliquots of initiator can be added during the reaction period and at the end of the reaction period.

In another embodiment of the invention, there are as many as 5 or more distinct aliquots of initiator added to the reaction mixture over the course of the reaction separate from the initial aliquot that begins the polymerization reaction. There can be as few as 1 additional aliquot of initiator added or more, preferably as few as two additional aliquots of initiator are added to the reaction mixture after the initial aliquot that begins the reaction. There can be up to 6 distinct aliquots of initiator added to the reaction mixture in addition to the initial aliquot that begins the polymerization reaction over the course of the reaction.

Multiple, discrete additions of free radical initiator have a significant impact of the performance properties of the polymer. For the purposes of this invention the term "discrete additions of initiator" does not include the initial addition of initiator used to start the polymerization reaction nor does it include the addition of a burnout aliquot(s) of initator. The initiator will have an impact on the rate at which free radicals are formed and/or the relative concentration of radicals. Without being bound by any theory, it is believed that this, in turn, can influence the molar mass, copolymer composition, and other physical attributes of the polymer. Furthermore, the rate at which free radicals are formed, the relative concentration of radicals, and/or the reactivity of the initiator can influence the amount of initiator used, which, in turn, can affect the molar mass and other physical attributes of the polymer.

The use of thermal initiators is preferred. Thermal initiators are a group of materials that decompose at a temperature characteristic of the initiator to form a free radical that will initiate polymerization of ethylenically unsaturated monomer, also known as vinyl, allyl, or acrylic monomers. These materials are the most common type of initiators in commercial use. Thermal initiators include, but are not limited to, peroxides, persulfates, and azo compounds. Exemplary peroxide materials include, but are not limited to, benzoyl peroxide, lauroyl peroxide, t-butylperoxide, t-butyl hydroperoxide and the like and mixtures thereof. Exemplary persulfates include, but are not limited to, ammonium persulfate, potassium persulfate and mixtures thereof and the like. Exemplary azo compounds include, but are not limited to, 2,2-azobis(2-methylproprionitrile), also known as azobisisobutylonitrile or AIBN; 4,4'-azobis(cyanovaleric acid); 1-1'azobis(cyclohexanecarbonitrile) mixtures thereof and the like.

For the purposes of this invention the initiator selected can be one initiator or can be a combination of two or more thermal initiators.

The associative polymer prepared by the present inventive process can be described as follows:

A water-soluble copolymer composition comprising the formula

—[B-co-F]— (Formula 1)

wherein B is a nonionic polymer segment formed from the polymerization of one or more ethylenically unsaturated nonionic monomers; F is an anionic, cationic, or a combination of anionic and cationic polymer segment(s) formed from polymerization of one or more ethylenically unsaturated anionic, and/or cationic monomers; the molar % ratio of B:F is from 95:5 to 5:95; and the water-soluble copolymer is prepared via a water-in-oil emulsion polymerization technique that employs at least one emulsification surfactant consisting of at least one diblock or triblock nonionic polymeric surfactant wherein the ratio of the at least one diblock or triblock surfactant to monomer is at least about 3:100 and wherein; the water-in-oil emulsion polymerization technique comprises the steps of: (a) preparing an aqueous solution of monomers, (b) contacting the aqueous solution with a hydrocarbon liquid containing surfactant or surfactant mixture to form an inverse emulsion, (c) causing the monomer in the emulsion to polymerize by free radical polymerization by the use of specific initiators at a pH range of from about 2 to less than 7.

In one advantageous embodiment of the invention the initiators are thermal initiators.

The associative polymer can be an anionic copolymer. The anionic copolymer is characterized in that its Huggins' constant (k') determined at a concentration between 0.0025 wt. % to 0.025 wt. % of the copolymer in 0.01M NaCl is greater than 0.75; and it has a storage modulus (G') for a 1.5 wt. % actives copolymer solution at 6.3 Hz greater than 75 Pa. In one embodiment of the invention the storage modulus (G') for a 1.5 wt. % actives copolymer solution at 6.3 Hz is between than 75 Pa and 170 Pa.

The associative polymer can be a cationic copolymer. The cationic copolymer is characterized in that its Huggins' constant (k') determined between 0.0025 wt. % to 0.025 wt. % of the copolymer in 0.01M NaCl is greater than 0.5; and it has a storage modulus (G') for a 1.5 wt. % actives copolymer solution at 6.3 Hz greater than 30 Pa.

The associative polymer can be an amphoteric copolymer. The amphoteric copolymer is characterized in that its Huggins' constant (k') determined between 0.0025 wt. % to 0.025 wt. % of the copolymer in 0.01M NaCl is greater than 0.5 and has a storage modulus (G') for a 1.5 wt. % actives copolymer solution at 6.3 Hz greater than 30 Pa.

Inverse emulsion polymerization is a standard chemical process for preparing high molecular weight water-soluble polymers or copolymers. In general, an inverse emulsion polymerization process is conducted by 1) preparing an aqueous solution of the monomers, 2) contacting the aqueous solution with a hydrocarbon liquid containing appropriate emulsification surfactant(s) or surfactant mixture to form an inverse monomer emulsion, 3) subjecting the monomer emulsion to free radical polymerization, and, optionally, 4) adding a breaker surfactant to enhance the inversion of the emulsion when added to water.

Inverse emulsion polymers are typically water-soluble polymers based upon ionic or non-ionic monomers. Polymers containing two or more monomers, also referred to as copolymers, can be prepared by the same process. These co-monomers can be anionic, cationic, zwitterionic, nonionic, or a combination thereof.

Typical nonionic monomers, include, but are not limited to, acrylamide; methacrylamide; N-alkylacrylamides, such as N-methylacrylamide; N,N-dialkylacrylamides, such as N,N-dimethylacrylamide; methyl acrylate; methyl methacrylate; acrylonitrile; N-vinyl methylacetamide; N-vinyl formamide; N-vinyl methyl formamide; vinyl acetate; N-vinyl pyrrolidone; hydroxyalkyl(meth)acrylates such as hydroxyethyl (meth)acrylate or hydroxypropyl(meth)acrylate; mixtures of any of the foregoing and the like.

Exemplary anionic monomers include, but are not limited to, the free acids and salts of: acrylic acid; methacrylic acid; maleic acid; itaconic acid; acrylamidoglycolic acid; 2-acrylamido-2-methyl-1-propanesulfonic acid; 3-allyloxy-2-hydroxy-1-propanesulfonic acid; styrenesulfonic acid; vinylsulfonic acid; vinylphosphonic acid; 2-acrylamido-2-methylpropane phosphonic acid; mixtures of any of the foregoing and the like.

Exemplary cationic monomers include, but are not limited to, cationic ethylenically unsaturated monomers such as the free bases or salts of: diallyldialkylammonium halides, such as diallyldimethylammonium chloride; the (meth)acrylates of dialkylaminoalkyl compounds, such as dimethylaminoethyl (meth)acrylate, diethylaminoethyl(meth)acrylate, dimethylaminopropyl (meth)acrylate, 2-hydroxydimethylaminopropyl(meth)acrylate, aminoethyl (meth)acrylate,and the salts and quaternaries thereof; the N,N-ialkylaminoalkyl (meth)acrylamides, such as N,N-dimethylaminoethylacrylamide, and the salts and quaternaries thereof and mixture of the foregoing and the like.

The co-monomers may be present in any ratio. The resultant associative polymer can be non-ionic, cationic, anionic, or amphoteric (contains both cationic and anionic charge).

The associative polymer can be an anionic copolymer, with a molar ratio of nonionic monomer to anionic monomer (B:F of Formula I) within the range of 95:5 to 5:95, preferably the range is from about 75:25 to about 25:75 and even more preferably the range is from about 65:35 to about 35:65 and most preferably from about 60:40 to about 40:60. In this regard, the molar percentages of B and F must add up to 100%. It is to be understood that more than one kind of nonionic monomer may be present in the Formula I. It is also to be understood that more than one kind of anionic monomer may be present in the Formula I.

In one preferred embodiment of the invention, the associative polymer is an anionic copolymer defined by Formula I where B, the nonionic polymer segment, is the repeat unit formed after polymerization of acrylamide; and F, the anionic polymer segment, is the repeat unit formed after polymerization of a salt or free acid of acrylic acid and the molar % ratio of B:F is from about 75:25 to about 25:75

The physical characteristics of the associative polymer, when it is an anionic copolymer, are unique in that the Huggins' constant (k') as determined in 0.01M NaCl is greater than 0.75 and the storage modulus (G') for a 1.5 wt. % actives polymer solution at 6.3 Hz is greater than 75 Pa, preferably greater than 90 Pa and even more preferably greater than 105 Pa. The Huggins' constant is greater than 0.75, preferably greater than 0.9 and even more preferably greater than 1.0

The associative polymer can be a cationic copolymer, with a molar ratio of nonionic monomer to cationic monomer (B:F of Formula I) may fall within the range of 99:1 to 50:50, or 95:5 to 50:50, or 95:5 to 75:25, or 90:10 to 60:45, preferably the range is from about 85:15 to about 60:40 and even more preferably the range is from about 80:20 to about 50:50. In this regard, the molar percentages of B and F must add up to 100%. It is to be understood that more than one kind of nonionic monomer may be present in the Formula I. It is also to be understood that more than one kind of cationic monomer may be present in the Formula I.

The associative polymer can be an amphoteric copolymer of Formula I, with the minimum molar percentage of each of the anionic, cationic and non-ionic monomer being 1% of the total amount of monomer used to form the copolymer. The maximum amount of the non-ionic, anionic, or cationic monomer is 98% of the total amount of monomer used to form the copolymer. Preferably the minimum amount of any of anionic, cationic, and non-ionic monomer is 5%, more preferably the minimum amount of any of anionic, cationic and non-ionic monomer is 7% and even more preferably the minimum amount of any of anionic, cationic, and non-ionic monomer is 10% of the total amount of monomer used to form the copolymer. In this regard, the molar percentages of anionic, cationic, and non-ionic monomer must add up to 100%. It is to be understood that more than one kind of nonionic monomer may be present in the Formula I, more than one kind of cationic monomer may be present in the Formula I, and that more than one kind of anionic monomer may be present in the Formula I.

The physical characteristics of the associative polymer, when it is a cationic or amphoteric copolymer, are unique in that its Huggins' constant (k') as determined in 0.01M NaCl is greater than 0.5. It is expected that the storage modulus (G') of a 1.5 wt. % actives polymer solution at 6.3 Hz for the cationic or amphoteric copolymer is greater than 30 Pa, preferably greater than 50 Pa. The Huggins' constant is greater than 0.5, preferably greater than 0.6, or greater than 0.75, or greater than 0.9 or greater than 1.0.

The emulsification surfactant or surfactant mixture used in an inverse emulsion polymerization system can have an important effect on both the manufacturing process and the resultant product. Surfactants used in emulsion polymerization systems are known to those skilled in the art. These surfactants typically have a range of HLB (Hydrophilic Lipophilic Balance) values that is dependent on the overall surfactant composition. One or more emulsification surfactants can be used. The emulsification surfactant(s) of the polymerization products that are used to produce the associative polymer include at least one diblock or triblock polymeric surfactant. It is known that these surfactants are highly effective emulsion stabilizers. The choice and amount of the emulsification surfactant(s) are selected in order to yield an inverse monomer emulsion for polymerization.

Diblock and triblock polymeric emulsification surfactants are used to provide unique materials. When the diblock and triblock polymeric emulsification surfactants are used in the necessary quantity unique polymers exhibiting unique characteristic result as described in WO 03/050152 A1 and US 2004/0143039 A1, the entire contents of each are herein incorporated by reference. Exemplary diblock and triblock polymeric surfactants include, but are not limited to, diblock and triblock copolymers based on polyester derivatives of fatty acids and poly(ethylene oxide), such as Hypermer® B246SF, a product of Uniqema, New Castle, Del.); diblock and triblock copolymers based on polyisobutylene succinic anhydride and poly(ethylene oxide); reaction products of ethylene oxide and propylene oxide with ethylenediamine; mixtures of any of the foregoing and the like. Preferably the diblock and triblock copolymers are based on polyester derivatives of fatty acids and poly(ethylene oxide). When a triblock surfactant is used, it is preferable that the triblock contains two hydrophobic regions and one hydrophilic region, i.e., hydrophobe-hydrophile-hydrophobe. Preferably, one or more surfactants are selected in order to obtain a specific HLB value.

The amount (based on weight percent) of diblock or triblock surfactant is dependent on the amount of monomer used to form the associative polymer. The ratio of diblock or triblock surfactant to monomer is at least about 3 to 100. The amount of diblock or triblock surfactant to monomer can be greater than 3 to 100 and preferably is at least about 4 to 100 and more preferably 5 to 100 and even more preferably about 6 to 100. The diblock or triblock surfactant is the primary surfactant of the emulsification system.

A secondary emulsification surfactant can be added to ease handling and processing, to improve emulsion stability, or to alter the emulsion viscosity. Examples of secondary emulsification surfactants include, but are not limited to, sorbitan fatty acid esters, such as sorbitan monooleate, such as Atlas G-946, a product of Uniqema, New Castle, Del.:, ethoxylated sorbitan fatty acid esters; polyethoxylated sorbitan fatty acid esters; the ethylene oxide and/or propylene oxide adducts of alkylphenols; the ethylene oxide, and/or propylene oxide adducts of long chain alcohols or fatty acids; mixed ethylene oxide/propylene oxide block copolymers; alkanolamides; sulfosuccinates; and mixtures thereof and the like.

Polymerization of the inverse emulsion may be carried out in any manner known to those skilled in the art. Examples can be found in, among other references, Allcock and Lampe, *Contemporary Polymer Chemistry*, (Englewood Cliffs, N.J., PRENTICE-HALL, 1981), chapters 3-5.

The associative polymer is typically diluted at the application site to produce an aqueous solution of 0.1 to 1% active copolymer. This dilute solution of the associative polymer is then added to the paper process to affect retention and drainage. The associative polymer may be added to the thick stock or thin stock, preferably the thin stock. The associative polymer copolymer may be added at one feed point, or may be split fed, such that the associative polymer is fed simultaneously to two or more separate feed points. Typical stock addition points include feed point(s) before the fan pump, after the fan pump, and before the pressure screen or after the pressure screen.

The associative polymer of the present invention may be added in an amount effective to achieve the desired level of flocculation. Preferably, the associative polymer is employed in an amount of at least about 0.03 to about 0.5 Kg of active copolymer per metric ton of cellulosic pulp, based on the dry weight of the pulp. The amount of copolymer used in the application could be more than 1.0 Kg/metric ton. The concentration of copolymer is preferably from about 0.05 to about 0.5 Kg of active copolymer per metric ton of dried cellulosic pulp. More preferably the copolymer is added in an amount of from about 0.05 to 0.4 Kg per metric ton of dried cellulosic pulp and, most preferably from about 0.1 to about 0.3 Kg per metric ton based on dry weight of the cellulosic pulp.

The associative polymer of the present invention can be used with one or more additional or second components. The additional or second component can be selected from several materials.

Siliceous materials can be used as the second or additional component. The siliceous material may be any of the materials selected from the group consisting of silica based particles, silica microgels, amorphous silica, colloidal silica, anionic colloidal silica, silica sols, silica gels, polysilicates, polysilic acid, and the like. These materials are characterized by the high surface area, high charge density, and submicron particle size.

This group of siliceous materials includes stable colloidal dispersion of spherical amorphous silica particles, referred to in the art as silica sols. The term sol refers to a stable colloidal dispersion of spherical amorphous particles. Silica gels are three dimensional silica aggregate chains, each comprising several amorphous silica sol particles that can also be used in retention and drainage aid systems; the aggregate chains may be linear or branched. Silica sols and gels are prepared by polymerizing monomeric silicic acid into a cyclic structure that result in discrete amorphous silica sols of polysilicic acid. These silica sols can be reacted further to produce three-dimensional gel network. The various silica particles (sols, gels, etc.) can have an overall size of 5-50 nm. Anionic colloidal silica can also be used.

Another type of inorganic particle used is clay. The term clay is applied to a number of mineral groups considered to be phyllosilicates, a subclass of silicates. Clays, therefore, include chlorites, illites, kaolinites, montmorillonites, and smectites.

Bentonite is a term in the art applied to a class of materials, typically aggregates of two or more minerals. These mineral aggregates occur naturally, although these materials may undergo chemical and/or physical processing to modify their properties. One important component, due to its interactions with water, is a smectite clay mineral. Smectitie minerals are three-dimensional particles up to 300 nm long with a uniform thickness of <1 nm and consist of oxygen, silica, and a metal ion, typically aluminum and/or magnesium. Bentonite, the most common clay now in commercial use in retention and drainage, is a montmorillonite. Typically, a montmorillonite is the smectite used to make colloidal bentonite microparticles. Montmorillonite has a di-octahedral structure and a strong negative charge in water. It is the high anionic charge, electrical double layer in solution, and small particle size that make montmorillonite a colloidal particle.

Any inorganic particle can be used, including, but not limited to, aluminum hydroxide and perlite.

An alternative additional or second component of the retention and drainage system can be an organic micropolymer or microbead. Organic micropolymers are crosslinked, ionic, organic polymeric materials. They are copolymers of a nonionic monomer, an ionic monomer and a crosslinking agent. Further, the ionic monomer may be anionic or cationic. Use of both anionic and cationic monomers results in amphoteric materials. The micropolymers are typically formed by the polymerization of ethylenically mono- and di-unsaturated monomers that can be anionic, cationic, or nonionic. Inverse emulsion polymerization is typically used to prepare these materials. One example of a micropolymer is Polyflex® CP.3. (Ciba Specialty Chemicals, Tarrytown, N.Y.)

Another alternative second or additional component of the retention and drainage system can be one of a number of ionic polymeric materials or polyelectrolytes. These materials are often referred to by those skilled in the art as coagulants or flocculants, thickeners, wet strength resins, dry strength resins, and rheology control additives. It is contemplated that any water soluble or water dispersible polyelectrolyte can be used in conjunction with the associative polymer. The material may be a single product or blend of materials. These materials may differ in their chemical nature, as influenced by the monomer composition, nature of the ionic functionality, amount of ionic functionality, distribution of the ionic functionality along the polymer chain, and the physical nature of the polymer, such as the molecular weight, charge density, and secondary/tertiary structure.

Another alternative additional or second component of the retention and drainage system can be one of several aluminum compounds. Particularly preferred is alum (aluminum sulfate).

Aluminum compounds include, but are not limited to, aluminum chloride, aluminum chlorohydrate (ACH), polyaluminum silicate sulfate (PASS) and polyaluminum chloride (PAC). PAC is the name given to a complex of polyhydroxyl chloride of aluminum having the general formula:

$$Al_n(OH)_mCl_{3n-m}$$

The simplest PAC is a dimer, having the chemical formula:

$$Al_n(OH)_2(H_2O)_8^+$$

While the accepted formula for the polymers is:

$$[AlO_4Al_{12}(OH)_{24}(H_2O)_{12}]^{+7}$$

Another alternative additional component of the retention and drainage system is poly(vinylamine), a copolymer typically produced by the polymerization of N-vinylformamide followed by hydrolysis to form the amine. The material can be hydrolyzed using either acidic or basic conditions; basic is preferred. The degree of hydrolysis, and resultant charge density, can be varied by controlling the hydrolysis reaction. Poly(vinylamine) can also be prepared by the copolymerization of vinylformamide and comonomers, including those listed above. Other synthetic routes to a poly(vinylamine) can be utilized.

Yet another alternative second or additional component of the retention and drainage system is starch and derivatives thereof. Starch is the common name for a polymer of glucose that contains alpha-1,4 linkages. Starch is a naturally occurring material; this carbohydrate can be found in the leaves, stems, roots and fruits of most land plants. The commercial sources of starch include, but are not limited to, the seeds of cereal grains (corn, wheat, rice, etc.), and certain roots (potato, tapioca, etc.). Starch is described by its plant source; reference would be made to, for example, corn starch, potato starch, tapioca starch, rice starch, and wheat starch.

Glucose is composed of carbon, hydrogen, and oxygen in the ratio of 6:10:5 ($C_6H_{10}O_5$), placing it in the class of carbohydrate organic compounds. Starch can be considered to be a condensation polymer of glucose.

Most starches consist of a mixture of two polysaccharide types: amylose, an essentially linear polymer, and amylopectin, a highly branched polymer. The relative amounts of amylose and amylopectin vary with the source, with the ratio of amylose to amylopectin typically being 17:83 for tapioca, 21:79 for potato, 28:72 for corn and 0:100 for waxy maize corn. Although these are the typical starch ratios found, the present invention contemplates that any ratio of amylose to amylopectin can be useful in the present invention.

Amylose is a linear polymer consisting of a chain of glucose units connected to each other by alpha-1,4 linkages. The molecular weight can range from about 30,000 to about 1,000,000.

Amylopectin is a highly branched structure of short amylose chains having molecular weight from about 2000 to about 10,000 connected via alpha-1,6, linkages to form a very complex, very high molecular weight (10,000,000 to 100,000,000) polymer.

Starch is synthesized by plants and accumulates in granules that are distinctive for each plant. Starch granules are separated from the plant through a milling and grinding process. The granules are insoluble in cold water and must be heated above a critical temperature in order for the granules to swell and rupture, allowing the polymer to dissolve in solution.

Starch can be modified to provide specific properties of value in selected applications. This includes modification to either or both the physical and chemical structure of the material. Physical modification includes reduction in molecular weight, which is most often achieved by hydrolysis. Such modified materials are often referred to as derivatized starch or starch derivatives.

Chemical modifications include, but are not limited to, reactions that result in oxidized starches, such as by reaction with hypochlorite; reactions to form crosslinked starch, such as by using crosslinkers such as epichlorohydrin, sodium trimetaphosphate, isocyanates, or N,N-methylenebisacrylamide; reactions to form starch ester, such as by reaction with acetic acid or succinic anhydride; reactions to form hydroxyalkyl starches, such as by reaction with ethylene oxide or propylene oxide; reactions to form phosphate monoesters, such as by reaction with sodium tripolyphosphate; reactions to form cationic starch, such as by reaction with diethylamino ethyl chloride, tertiary amines and epichlorohydrin, or ethyleneamine; reactions to form dialdehyde starch, such as by acid oxidation, or starch xanthates; and the like. For the purposes of this invention, any type of chemically modified starch is contemplated to be useful.

Yet another alternative additional or second component of the retention and drainage system is an inorganic material, often, but not necessarily, referred to as a mineral. These materials include, but are not limited to, clay, calcium carbonate, talc, titanium dioxide, diatomaceous silica, calcium sulfate, zinc oxide and zeolites. These materials may be found in nature or synthesized via a chemical process. Further, the materials may be modified via chemical or physical treatment; both chemical and physical treatments, either sequentially or simultaneously, may be done on these materials. Calcium carbonate may be ground or precipitated.

Zeolites are microporous crystal solids with well defined structures. They contain, in general, silicon, aluminum and oxygen atoms. Zeolites can be natural, synthetic or modified.

Yet another alternative additional or second component of the retention and drainage system can be another polymer that is water compatible. By "water compatible" we mean that the polymer can be water soluble or water swellable or water dispersible.

The term water soluble is used to indicate that the polymer will dissolve in the solvent, with no visible solid material remaining in the solvent. Solubility of a polymer in a solvent occurs when the free energy of mixing is negative. Examples of water soluble materials include, but are not limited to, exudates or gum, extractives, natural materials, modified natural materials, or synthetic material. One example of exudates or gum is gum tragacanth. One example of extractives is pectin. One example of natural materials is guar. One example of modified natural materials is derivatized cellulose such as methylcellulose. One example of synthetic material is poly(acrylic acid). The synthetic polymers can be comprised of one or more monomers selected to provide specific properties to the final polymer.

Water swellable polymers are those that can imbibe the aqueous solvent and swell to a limited extent. This swelling behavior is influenced by a number of factors including, but not limited to, crosslinking. Thus, the interactions between polymer and solvent are limited and although a visible homogeneous solution is obtained, a uniform molecular dispersion can not be attained. An example is a crosslinked polymer, with acrylic acid polymers and copolymers used in the art as absorbents or superabsorbents being specific examples. They can be water compatible and water dispersible.

Water compatible materials are those that are not soluble in water, but do not phase separate. Typically, these materials have a modified surface that allows them to remain as discrete particulate material that is suspended in water, or can be made dispersible by the addition of other materials. Examples include latex particles, oil-in-water emulsions, and dispersed clays or pigments.

Yet another alternative second or additional component of the retention and drainage system can be metal salts, including, but not limited to, salts of magnesium, calcium, barium, iron, cobalt, nickel, copper, zinc, aluminum and silicon. Simple salts consist of positive and negative ions in a structural arrangement that results in the minimum distance between the two ions with maximum shielding of like charges from one another. A given metal salt may be, depending on its composition, soluble or insoluble. Solubility in aqueous media can be affected by temperature, pH, and presence of other materials. The use of soluble salts is preferred.

The soluble materials can interact with other ionic material in solution, modifying their properties and activity in specific applications. These species can mediate the activity of another material, acting in many ways including, but not limited to, bridging and neutralizing. The impact of these species may be particularly significant for polyelectrolytes, for the presence of salt ions can dramatically affect the structure of the polymer in solution and its charge density. One example of modifying soluble salts is to produce a soluble metal silicate, as described in U.S. Pat. Nos. 6,379,501 and 6,358,365. These patents teach the combination of a monovalent cation silicate and divalent metal ions in an aqueous environment to form a water-soluble metal silicate complex. The complex contains at least one aluminum compound, and at least one water-soluble silicate. The water-soluble silicate can be a monovalent cation silicate or a water-soluble metal silicate complex. The water-soluble metal silicate complex can be a reaction product of a monovalent cation silicate and divalent metal ions. The molar ratio of the aluminum compound to the water-soluble silicate, based on $Al_2O_3$ and $SiO_2$, is from about 0.1 to 10, preferably from about 0.2 to 5, and more preferably from about 0.5 to 2.

Examples of metal salts useful in the present invention include, but are not limited to, metal silicates, ferric(II)chloride, anhydrous $FeCl_3$, $ZnSO_4.4H_2O$, $MgCl_2$ and combinations thereof.

Yet another alternative additional or second component of the retention and drainage system is cyclic organic materials. One of the unique aspects of these materials is their ability to form a complex with other, typically low molecular weight, molecules or ions. These interactions have been termed "guest-host" chemistry, with the cyclic materials being the host and the smaller guest molecule forming a complex where it assumes a position inside the ring-like "host". Examples of these compounds, also called macrocyclic compounds, include, but are not limited to, crown ethers, cyclodextrins, and macrocyclic antibiotics.

Crown ethers are cyclic oligomers of ethylene glycol comprising carbon, hydrogen, and oxygen. Each oxygen atom is bound to two carbon atoms, resulting the "crown" like ring. These molecules are such that atoms of certain metallic elements, such as sodium and potassium, attach themselves to the exposed oxygen atoms of the ring, sequestering it. These materials, due to their chemistry and the size of the ring, are highly selective for specific molecules.

Cyclodextrins are cyclic starch derivatives that occur in nature or can be synthesized using enzymes such as cyclomaltodextrin glucosyltransferase. The naturally occurring cyclodextrins are referred to an alpha-, beta-, and gamma-cyclodextrin. Cyclodextrins form stable complexes with other compounds.

Macrocyclic antibiotic is a term given to a series of cyclic compounds with antibiotic activity. Due to their structure, they will selectively complex with molecules. Exemplary macrocyclic antibiotics include, but are not limited to, rifamycin, vancomycin and ristocetin A.

Yet another alternative additional or second component of the retention and drainage system can be one of several materials based on silicone. One example is silicone oil, a term originally applied to poly(dimethylsiloxane), a clear fluid. Other similar materials, including, but not limited to, poly (phenylmethyl silicone) and poly(tetramethyl tetraphenylsiloxane.

Yet another alternative second component of the retention and drainage system is a bridging agent based on a metal such as aluminum, titanium, or zirconium. These materials act by reacting with other materials and can interact with multiple sites to form bridges between the polymer chains; the bridging can occur through hydroxyl, amino, amido, carboxyl, or thio groups. These bridging reactions are useful in viscosity control and surface modification. The organic titanates and zirconates are used in augmenting coating, printing inks, and adhesives.

Titanate and zirconate esters are one example of these materials, with tetraalkyl esters being most common. Suitable alkyl groups for organic titanates and organic zirconates include, but are not limited to, isopropyl, butyl, and ethylhexyl groups.

Organic chelants can also be used as bridging agents. The chelants can comprise of acetylacetonate, ethyl acetoacetate, lactate, glycolate, and triethanolamine derivatives. Exemplary materials are sold under the Tyzor tradename (DuPont, Wilmington, Del.).

Zirconium carbonates can also be used, of which ammonium zirconium carbonate is the most common. Ammonium zirconium carbonate is used as a bridging agent and insolubilizer in the paper industry.

The additional or second component of the retention and drainage system can be added at amounts up to 0.5 kg of active material per metric ton of cellulose pulp based on dry weight of the pulp, with the ratio of the associative polymer to additional or second component being 1:1 to 100:1. It is contemplated that more than one additional or second component can be used in the papermaking system.

Optionally siliceous materials cited above can be used as an additional or third component of the retention and drainage aid used in making paper and paperboard with the other second or additional components. The siliceous material may be any of the materials selected from the group consisting of silica based particles, silica microgels, amorphous silica, colloidal silica, anionic colloidal silica, silica sols, silica gels, polysilicates, polysilicic acid, and the like. These materials are characterized by the high surface area, high charge density and submicron particle size.

This group includes stable colloidal dispersion of spherical amorphous silica particles, referred to in the art as silica sols. The term sol refers to a stable colloidal dispersion of spherical amorphous particles. Silica gels are three dimensional silica aggregate chains, each comprising several amorphous silica sol particles, that can also be used in retention and drainage aid systems; the chains may be linear or branched. Silica sols and gels are prepared by polymerizing monomeric silicic acid into a cyclic structure that result in discrete amorphous silica sols of polysilicic acid. These silica sols can be reacted further to produce a three dimensional gel network. The various silica particles (sols, gels, etc.) can have an overall size of 5-50 nm. Anionic colloidal silica can also be used.

The siliceous material used as a third or additional component can be added to the cellulosic suspension in an amount of at least 0.005 Kg per metric ton based on dry weight of the cellulosic suspension. The amount of siliceous material may be as high at 50 Kg per metric ton. Preferably, the amount of siliceous material is from about 0.05 to about 25 Kg per metric ton. Even more preferably, the amount of siliceous material is from about 0.25 to about 5 Kg per metric ton based on the dry weight of the cellulosic suspension.

Optionally, an additional component of the retention and drainage aid system can be a conventional flocculant. This can be a third or fourth component. A conventional flocculent is generally a linear cationic or anionic copolymer of acrylamide. The additional component of the retention and drainage system is added in conjunction with the aluminum compound and the associative polymer to provide a multi-component system which improves retention and drainage.

The conventional flocculant can be an anionic, cationic or non-ionic polymer. The ionic monomers are most often used to make copolymers with a non-ionic monomer such as acrylamide. These polymers can be provided by a variety of synthetic processes including, but not limited to, suspension, dispersion and inverse emulsion polymerization. For the last process, a microemulsion may also be used.

The co-monomers of the conventional flocculant may be present in any ratio. The resultant copolymer can be non-ionic, cationic, anionic, or amphoteric (contains both cationic and anionic charge).

Yet other additional components that can be part of the inventive system are aluminum sources such as alum (aluminum sulfate), polyaluminum sulfate, polyaluminum chloride and aluminum chlorohydrate. This material can be considered to be a third, fourth or fifth component of the system.

The components of a retention and drainage system may be added substantially simultaneously to the cellulosic suspension. The term retention and drainage system is used here to encompass two or more distinct materials added to the papermaking slurry to provide improved retention and drainage. For instance, the components may be added to the cellulosic suspension separately either at the same stage or dosing point or at different stages or dosing points. When the components of the inventive system are added simultaneously any two of more of the materials may be added as a blend. The mixture may be formed in situ by combining the materials at the dosing point or in the feed line to the dosing point. Alternatively the inventive system comprises a preformed blend of the materials. In an alternative form of the invention the components of the inventive system are added sequentially. A shear point may or may not be present between the addition points of the components. The components can be added in any order.

The inventive system is typically added to the paper process to affect retention and drainage. The inventive system may be added to the thick stock or thin stock, preferably the thin stock. The system may be added at one feed point, or may be split fed such that the inventive system is fed simultaneously to two or more separate feed points. Typical stock addition points include feed points(s) before the fan pump, after the fan pump and before the pressure screen, or after the pressure screen.

The inventive associative copolymer provides improved retention and drainage properties over similar polymers made without the use of discrete multiple additions of initiator during the polymerization process. The inventive associative copolymer provides an at least 2 percent improvement in retention, preferably at least 3 percent improvement in retention, more preferably at least 4 percent improvement in retention. The inventive associative copolymer provides an at least 5 percent improvement in drainage time, preferable at least 7 percent improvement in drainage time and more preferable at least 10 percent increase in drainage time.

EXAMPLES

Example 1 (Comparative Example)

To a suitable reaction flask equipped with an overhead mechanical stirrer, thermometer, nitrogen sparge tube, and condenser was charged an oil phase of paraffin oil (139.72 g, Escaid 110 oil, ExxonMobil, Houston, Tex.) containing surfactants (10.00 g Hypermer® B246SF (Uniqema, New Castle, Del.) and 5.00 g sorbitan monooleate).

An aqueous phase was prepared separately which comprised 50 wt % acrylamide (AAm) solution in water (129.13 g, 50 molar % based on total monomer), glacial acrylic acid (66.11 g, 50 molar % based on total monomer), deionized water (106.91 g), and Versenex 80 (Dow Chemical) chelant solution (0.69 g). The pH of the aqueous solution is adjusted to approximately 5-6 with a 50% NaOH solution.

The aqueous phase was then charged to the oil phase while simultaneously mixing with a homogenizer to obtain a stable water-in-oil emulsion. This emulsion is then mixed with a 4-blade glass stirrer while being sparged with nitrogen for 60 minutes. During the nitrogen sparge the temperature of the emulsion was adjusted to 57±1° C. Afterwards, the sparge was discontinued and a nitrogen blanket implemented.

The polymerization was initiated by feeding a 3 wt. % AIBN solution in toluene corresponding to an initial AIBN charge of 75 ppm on a total monomer molar basis. During the course of the reaction, the temperature of the inverse emulsion is maintained at 57±1° C. Four hours after the initial AIBN charge, a 3 wt. % AIBN solution in toluene corresponding to a second AIBN charge of 75 ppm on a total molar monomer basis, was charged into the reactor over ~30 seconds. Then the batch was held at 57±1° C. for 1.5 hours and heated to 65±1° C. over 0.5 hours. The final AIBN charge, a 3 wt. % AIBN solution in toluene corresponding to a final AIBN charge of 100 ppm on a total molar monomer basis, was charged into the reactor over ~30 seconds. The reaction continued for approximately one hour after the final initiator charge. The batch was then cooled to room temperature and the product collected.

The preparation of copolymer Examples 2-4 were conducted according to the method of Example 1, except for changes provided in the following text.

Example 2

Example 2 was prepared as in Example 1, except that initiator injections to start the polymerization, after half an hour of polymerization, after one hour of polymerization, and after 1.5 hours of polymerization were comprised of 3 wt % solutions in toluene of 75 molar ppm AIBN, 25 molar ppm AIBN, 25 molar ppm AIBN, and 25 molar ppm AIBN, respectively. All ppm values are on a total monomer basis.

Example 3

Example 3 was prepared as in Example 1, except that initiator injections to start the polymerization, after one hour of polymerization, after 1.5 hours of polymerization, and after four hours of polymerization were comprised of 3 wt % solutions in toluene of 75 molar ppm AIBN, 25 molar ppm AIBN, 25 molar ppm AIBN, and 25 molar ppm AIBN, respectively. All ppm values are on a total monomer basis.

Example 4

Example 4 was prepared as in Example 1, except that initiator injections to start the polymerization, after one hour of polymerization, and after four hours of polymerization were comprised of 3 wt % solutions in toluene of 50 molar ppm AIBN, 50 molar ppm AIBN, and 50 molar ppm AIBN, respectively. All ppm values are on a total monomer basis.

To evaluate the performance of the present invention, a series of drainage tests were conducted utilizing a synthetic alkaline furnish. This furnish is prepared from hardwood and softwood dried market lab pulps, and from water and further materials. First, the hardwood and softwood dried market lap pulp are refined separately. These pulps are then combined at a ratio of about 70 percent by weight of hardwood to about 30 percent by weight of softwood in an aqueous medium. The aqueous medium utilized in preparing the furnish comprises a mixture of local hard water and deionized water to a representative hardness. Inorganic salts are added in amounts so as to provide this medium with a total alkalinity of 75 ppm as $CaCO_3$ and hardness of 100 ppm as $CaCO_3$. Precipitated calcium carbonate (PCC) is introduced into the pulp furnish at a representative weight percent to provide a final furnish containing 80% fiber and 20% PCC filler.

Retention activity of the invention was determined using a Britt Jar. The results of this testing demonstrate the ability of the Britt Jar fines retention test to differentiate retention aids by the magnitude of the amount of fines retained. The Britt Jar fines retention method consists of a vaned jar, a 76 micron mesh size screen, a backing plate, and a rotor set 3.2 mm above the screen, held in place with an appropriate spacer. The rotor is used at a speed of 1000 rpm. The retention tests were conducted by mixing the furnish with the rotor and introducing the various chemical components into the furnish and allowing the individual components to mix for a specified time prior to the addition of the next component. A known volume of filtrate is collected and the turbidity of the filtrate is measured. The filtrate is then filtered a second time through a smaller mesh size screen to determine the percentage of fines vs. fiber that passed through the 76 micron mesh size screen.

The drainage tests were conducted by mixing the furnish with a mechanical mixer at a specified mixer speed, and introducing the various chemical components into the furnish and allowing the individual components to mix for a specified time prior to the addition of the next component. The specific chemical components and dosage levels are described in the data tables. The drainage activity of the invention was determined utilizing a Vacuum Drainage Test (VDT). The results of this testing demonstrate the ability of the VDT to differentiate drainage aids by the magnitude of the drainage time. The device setup is similar to the Buchner funnel test as described in various filtration reference books, for example see *Perry's Chemical Engineers' Handbook,* $7^{th}$ edition, (McGraw-Hill, New York, 1999) pp. 18-78.

The VDT consists of a 300-ml magnetic Gelman filter funnel, a 250-ml graduated cylinder, a quick disconnect, a water trap, and a vacuum pump with a vacuum gauge and regulator. The VDT test is conducted by first setting the vacuum pump with a vacuum gauge and regulator. The VDT test is conducted by first setting the vacuum to the desired level, typically 250 mm Hg, and placing the funnel properly on the cylinder. Next, 250 g of 0.5% wt. % paper stock is charged into a beaker and then the required additives according to treatment program (e.g., starch, alum, and testing flocculants) are added to the stock under the agitation provided by an overhead mixer. The stock is then poured into the filter funnel and the vacuum pump is turned on while simultaneously starting a stopwatch. The drainage efficacy is reported as the time, in seconds, required to obtain 230 ml of filtrate. Lower quantitative drainage time values represent higher levels of drainage or dewatering, which is the desired response.

Table 1 illustrates the utility of the invention. The test samples were prepared as follows: the furnish prepared as described above, is added, first, 5 Kg of cationic starch (Stalok 400, AE., Staley, Decatur, Ill.) per metric ton of furnish (dry basis), then 2.5 Kg of alum (aluminum sulfate octadecahydrate obtained from Delta Chemical Corporation, Baltimore, Md. as a 50% solution) per metric ton of furnish (dry basis), and then 0.25 Kg of PerForm PC8138 (Hercules Incorporated, Wilmington, Del.) per metric ton of furnish (dry basis) followed by the inventive material. These data indicate that addition of additional aliquots of initiator during the first 90 minutes of reaction results in a product with unexpectedly better retention and drainage performance.

In table 1 the storage modulus (G') was measured according to the method used in US patent application publication 2004/0143039 A1. G' was measured at 1.5 wt % polymer and at a frequency of 6.3 Hz.

TABLE 1

Retention and drainage results.

| Example | Retention 0.2 Kg/MT (%) | Improvement over Ex. 1 (%) | Drainage time 0.4 Kg/MT (s) | Improvement over Ex. 1 (%) | G' (Pa) |
|---|---|---|---|---|---|
| 1 | 76.3 | — | 16.4 | — | 256 |
| 2 | 79.4 | 4.06 | 13.9 | 15.2 | 146 |
| 3 | 79.7 | 4.46 | 14.4 | 12.2 | 136 |
| 4 | 80.5 | 5.50 | 13.5 | 17.7 | 151 |

The invention claimed is:

1. A method of improving retention and drainage in a papermaking process, the improvement comprising adding an associative polymer to a pulp slurry wherein the associative polymer comprises the formula:

B-co-F (I)

wherein B is a nonionic polymer segment comprising one or more ethylenically unsaturated nonionic monomers;

F is an polymer segment comprising at least one or more ethylenically unsaturated anionic or cationic monomer; and the molar percent ratio of B:F is 99:1 to 1:99 and wherein the associative polymer has associative properties provided by an effective amount of at least one emulsification surfactant chosen from diblock or triblock polymeric surfactants, and wherein the amount of the at least one diblock or triblock surfactant to monomer is at least about 3:100 and wherein the associative polymer is produced in a polymerization reaction by utilizing a first plurality of charges of initiator added during the first two hours of the polymerization reaction in the production of the associative polymer followed by one or more additional charges thereafter and, wherein the number of charges added during the first two hours exceeds the number of charges added thereafter, wherein the first plurality of charges of initiator are added as an initial charge of initiator followed by one to five additional discrete charges of initiator added at a period of time after said initial charge of initiator is stopped and after at least 5% completion of the polymerization reaction; and wherein at least one additional discrete final charge of initiator is added after said one to five additional discrete charges of initiator is stopped.

2. The method of claim 1 wherein the associative polymer is formed from monomers comprising at least one non-ionic monomers selected from the group consisting of acrylamide, methacrylamide, N-dialkylacrylamides, N-alkylacrylamides, N-vinyl methacetamide, N-vinyl formamide, N-vinyl methylformamide, N-vinyl pyrrolidone, and mixtures thereof.

3. The method of claim 2 wherein the associative polymer is formed from monomers further comprising at least one anionic monomer selected from the group consisting of the free acid or salt of: acrylic acid, methacrylic acid, sodium styrene sulfonate, 2-acrylamido-2-alkylsulfonic acids where the alkyl group contains 1 to 6 carbon atoms, or mixtures thereof.

4. The method of claim 1 wherein the addition of one or more of the one to five additional discrete charges of initiator occurs when the reaction is from about 5 to 60 percent complete.

5. The method of claim 1 wherein the addition of one or more of the one to five additional discrete charges of initiator occurs when the reaction is from about 10 to 60 percent complete.

6. The method of claim 1 wherein the anionic monomer comprises acrylic acid.

7. The method of claim 1 wherein the nonionic monomer comprises acrylamide.

8. The method of claim 1 wherein the anionic monomer comprises acrylic acid and the nonionic monomer comprises acrylamide.

9. The method as claimed in claim 1, wherein the associative polymer is produced by utilizing an initial charge of initiator followed by three additional discrete charges of initiator during the first two hours of the polymerization reaction in the production of the associative polymer.

10. The method claimed in claim 1 wherein at least one of the one to five additional discrete charges of initiator is added after about at least 15% completion of the polymerization reaction.

11. The method claimed in claim 1 wherein the total quantity of initiator is not more than 250 ppm on a total polymer basis.

* * * * *